US011841142B2

(12) United States Patent
Koehler

(10) Patent No.: US 11,841,142 B2
(45) Date of Patent: Dec. 12, 2023

(54) COLLAPSIBLE FIRE PIT

(71) Applicant: Kristin Koehler, Snowmass Village, CO (US)

(72) Inventor: Kristin Koehler, Snowmass Village, CO (US)

(73) Assignee: Kristin Koehler, Encinitas, CA (US)

( * ) Notice: Subject to any disclaimer, the term of this patent is extended or adjusted under 35 U.S.C. 154(b) by 166 days.

(21) Appl. No.: 17/560,620

(22) Filed: Dec. 23, 2021

(65) Prior Publication Data

US 2023/0044096 A1 Feb. 9, 2023

Related U.S. Application Data

(60) Provisional application No. 63/231,202, filed on Aug. 9, 2021.

(51) Int. Cl.
*F24B 1/191* (2006.01)
*F24B 1/20* (2006.01)

(52) U.S. Cl.
CPC ..... *F24B 1/191* (2013.01); *F24B 1/205* (2013.01)

(58) Field of Classification Search
CPC ..... F24B 1/205
See application file for complete search history.

(56) References Cited

U.S. PATENT DOCUMENTS

2003/0075166 A1* 4/2003 Glass ..... F24B 1/181 126/506
2006/0102163 A1* 5/2006 Sanders ..... A47J 33/00 126/30
2006/0272630 A1* 12/2006 Sanders ..... A47J 33/00 126/9 R
2009/0107483 A1* 4/2009 Fitzgerald ..... F24B 1/181 126/519
2019/0313851 A1* 10/2019 Shemp ..... A47J 37/0718
2021/0353049 A1* 11/2021 James ..... A47B 9/16
2022/0000312 A1* 1/2022 Motzkus ..... A47J 37/0763

* cited by examiner

*Primary Examiner* — David J Laux

(57) ABSTRACT

A number of different sized circular sections are maneuvered and locked to create a fully extended voluminous area, and also a number of adjustable legs are used to support the different sized sections so a fire may be created inside the voluminous area.

9 Claims, 8 Drawing Sheets

COLLAPSIBLE FIRE PIT

CROSS-REFERENCE TO RELATED APPLICATIONS

The present application claims priority to an earlier filed provisional patent application No. 63/231,202, filed on Aug. 9, 2021, and entitled "COLLAPSIBLE FIRE PIT", the entire contents of which are incorporated herein by reference.

FIELD OF INVENTION

The present application relates to a fire pit and more specifically, a collapsible and portable fire pit with telescoping/cascading sections which form a rigid structure for burning a fire.

BACKGROUND OF THE INVENTION

Conventionally, having a fire while camping involves consuming wood or other items which burn, and doing so in a particular area, and placing those items in a particular spot and initiating a fire via a flammable material. The location may include a rock pit or other defined area that is used to initiate the fire which can provide warmth, a cooking station, or other purposes.

In recent years, fires have burned out of control and have caused reconsideration and stricter rules regarding where a fire is permitted and how to control an outdoor fire. Portable fire pits are becoming increasingly popular, which may include a generally metal structure that maintains a secure area to burn wood or other combustible materials, or, to produce a constant flame from a gas line attached to a portable tank of propane. However, in order for a fire pit to burn to a satisfactory level, the size of the pit must be substantially larger than most objects one takes camping in a car. An ideal fire pit will be at least 30 inches in diameter, although sizes vary, if possible, a fire pit could be closer to 48 inches in diameter and as small as five inches or even smaller depending on the goals of the user or the amount of material (i.e., wood) to burn at any given time. Clearly, most vehicles cannot provide storage space for a fire pit that is several feet across and several feet off the ground, especially when passengers and luggage are in the vehicle.

SUMMARY OF THE INVENTION

Example embodiments of the present application disclose an apparatus that includes a plurality of different sized cylindrical sections, including a largest outer layer section and one or more inner layer sections affixed to one another to create a voluminous area when extended and locked via one or more locks, a plurality of pivoting legs to support the plurality of different sized sections off a resting surface, and the plurality of pivoting legs are extended upward along respective guide tracks.

BRIEF DESCRIPTION OF THE DRAWING(S)

DETAILED DESCRIPTION OF THE EMBODIMENT(S)

It will be readily understood that the components of the present application, as generally described and illustrated in the figures herein, may be arranged and designed in a wide variety of different configurations. Thus, the following detailed description of the embodiments of a method and apparatus, as represented in the attached figures, is not intended to limit the scope of the application as claimed, but is merely representative of selected embodiments of the application.

The features, structures, or characteristics of the application described throughout this specification may be combined in any suitable manner in one or more embodiments. For example, the usage of the phrases "example embodiments", "some embodiments", or other similar language, throughout this specification refers to the fact that a particular feature, structure, or characteristic described in connection with the embodiment may be included in at least one embodiment of the present application. Thus, appearances of the phrases "example embodiments", "in some embodiments", "in other embodiments", or other similar language, throughout this specification do not necessarily all refer to the same group of embodiments, and the described features, structures, or characteristics may be combined in any suitable manner in one or more embodiments.

Figure 1:
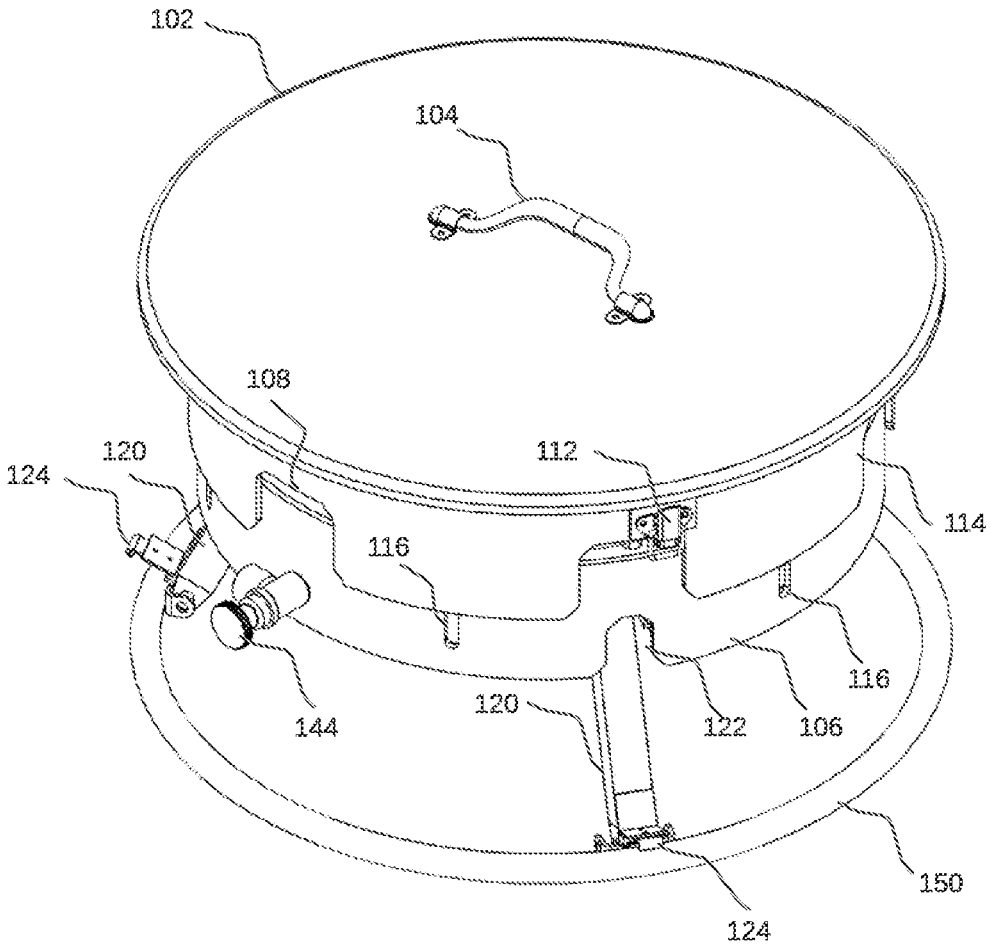
FIG. 1 illustrates a side view of a fire pit extended with a lid in accordance with example embodiments.

FIG. 1 illustrates a side view of an extended fire pit with a lid in accordance with example embodiments. Referring to FIG. 1 the fire pit may include two cascading and/or telescoping layers including the lower layer 106 and the upper layer 114. In other embodiments the number of layers may be three or four, etc. The base may be a substantially circular ring 150 where a number of legs 120 can be clamped via a claw-like clamp 124, which may be adjustable to provide a firm and locked position around the base ring 150. The clamp(s) 124 may also be locked into buckles 112 when the fire pit is in a locked and collapsed position. The buckles and the clamps may be on either the outer cylindrical layer or the inner cylindrical layer.

Elongated gaps 116 may be in several places around the lower layer 106 to permit a guide pin to roll from a rested position at the bottom of the gap to a locked position at the curved top of the gaps (see FIGS. 8A-8C) to create a lock. Gaps also provide air flow to feed the fire. Cut-out or open gap portions 108 may permit the top or upper layer 114 to be dropped over the legs 120 and the gas intake nozzle 144 without collision. The lower layer portion 106 may also have gaps 122 to permit the lower layer 106 to drop over the legs 120 into a fully collapsed position and to also provide air flow to the fire. A lid 102 with a handle 104 is optional but may also be strapped down or form-fitted to stay in place against a rim of the top layer 114 via a curved lip or other tight fitted component to hold the lid in place.

Figure 2:
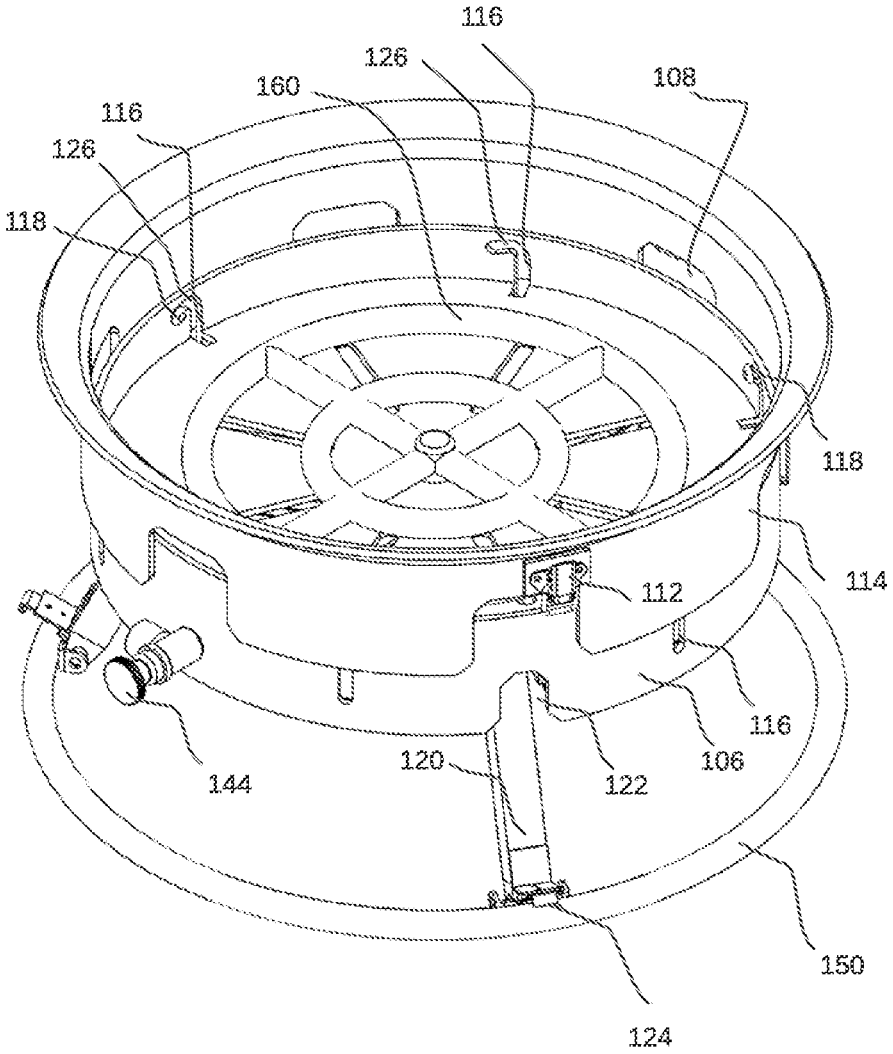
FIG. 2 illustrates a side view of the fire pit extended without a lid in accordance with example embodiments.

FIG. 2 illustrates a side view of the fire pit extended without a lid in accordance with example embodiments. Referring to FIG. 2, the lid is removed and the gas distribution array 160 is illustrated. The array 160 may have a plurality of holes throughout the array grid to permit propane fuel to permeate when lit with a lighting element. The gas input nozzle 144 may also include a push-button ignitor that ignites a spark to light the gas as it permeates through the array 160. Gas may be provided by a separate propane tank (not shown). The lower layer 106 may have a series of elongated gaps 116 with curved top portions 126 which permit a guide pin 118 to hold a locked and extended/erected position of the lower layer 106 and the upper layer 114 together. The guide pin may be affixed to the upper layer 114.

Figure 3:
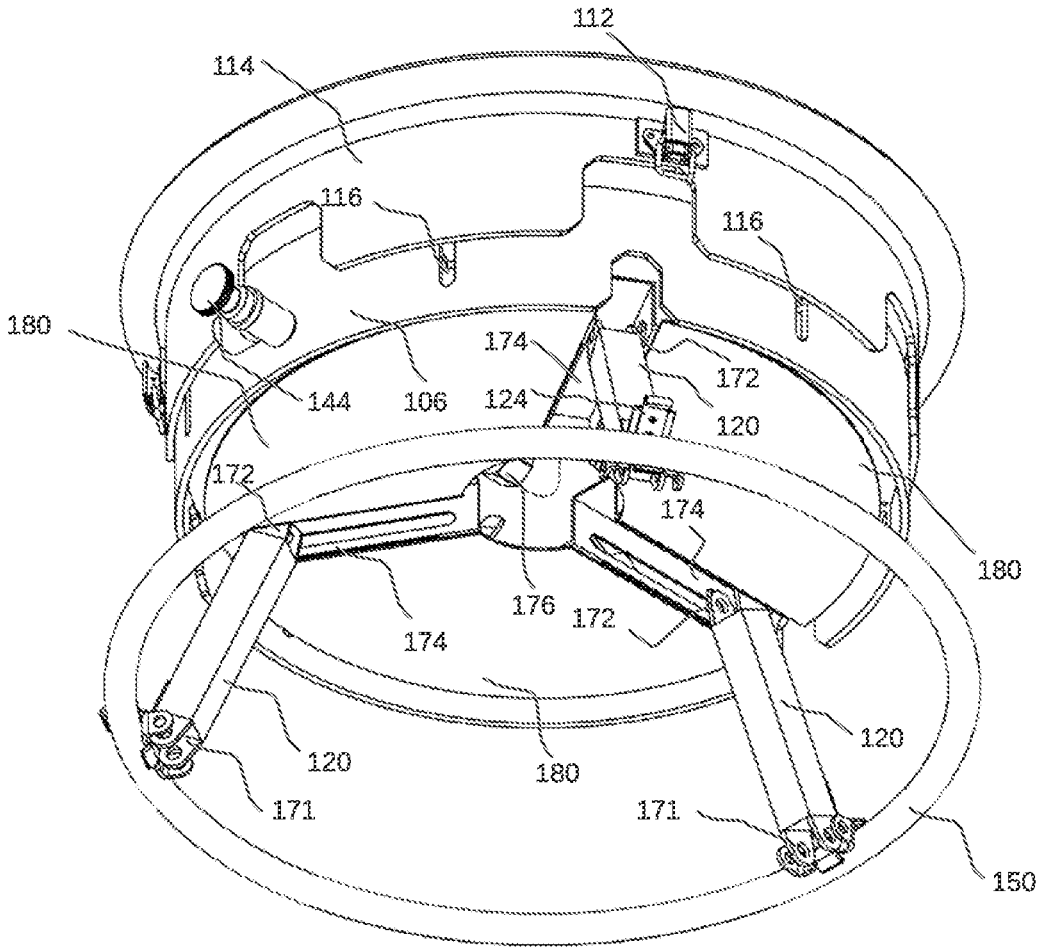
FIG. 3 illustrates a side/bottom view of the fire pit extended in accordance with example embodiments.

FIG. 3 illustrates a side/bottom view of the extended fire pit in accordance with example embodiments. Referring to FIG. 3, the legs are three in number, however, more legs may be possible depending on the design considerations. The legs 120 are rectangular (or could be cylindrical, triangular, etc.) and may be extended by simply lifting the top and bottom layers of the fire pit. The legs 120 are attached to sets of top 172 and bottom 171 guide pin holes which would have a pin or screw (not shown) used to hold the body of the legs, via the pin holes, in a position to rotate about an axis of the pin which may be affixed to the respective clamps 124 on one end and the guide rails 174 on the other end, all of which are under the bottom of the fire pit. A gas line 176 feeds the propane to the fire distribution array 160. Heat shields 180 may be between the guide rails/tracks 174 and may be locked to the tracks to hold the tracks in place, the heat shields may then be locked to the inner cylindrical layer 106.

A simple lifting operation would permit the weight of the legs 120 to fall downward with gravity until the top guide pin and hole portion 172 of the legs 120 are locked in position via a curved portion 178 of the guide rails 174 (see FIGS. 7A and 7B) in a similar manner to the curved portion 126 of the elongated gap 116. There may be a number of heat shields 180 beneath the fire pit, in this the example, the pit is cylindrical or circular and the heat shields 180 occupy approximately 120 degrees of the area semi-circular area since the legs 120 and the leg tracks 174 are disposed between the heat shields 180. The heat shields protect the ground from overheating and keep debris from falling on the ground and from moving from the ground into the fire inside the pit.

In another example, the legs may be telescoping similar to the body of the fire pit. The legs may have two, three or more sections which telescope out away from the pit towards the ground to create an increased distance between the pit and the ground. The legs may also fold under by a joint as opposed to a slidably movable track which permits the legs to be brought out at an angle as illustrated in the example embodiments. The legs may permit the fire pit to be elevated a larger distance, such as two or three feet. The pit may have an internal structure similar to a charcoal grill with a curved or flat enclosed bottom and no heating array, and as a result, wood, charcoal, gel or other materials may be burned to create heat and provide heat to a grill, which can be used to cook meat or other grill-top items.

Figure 4:
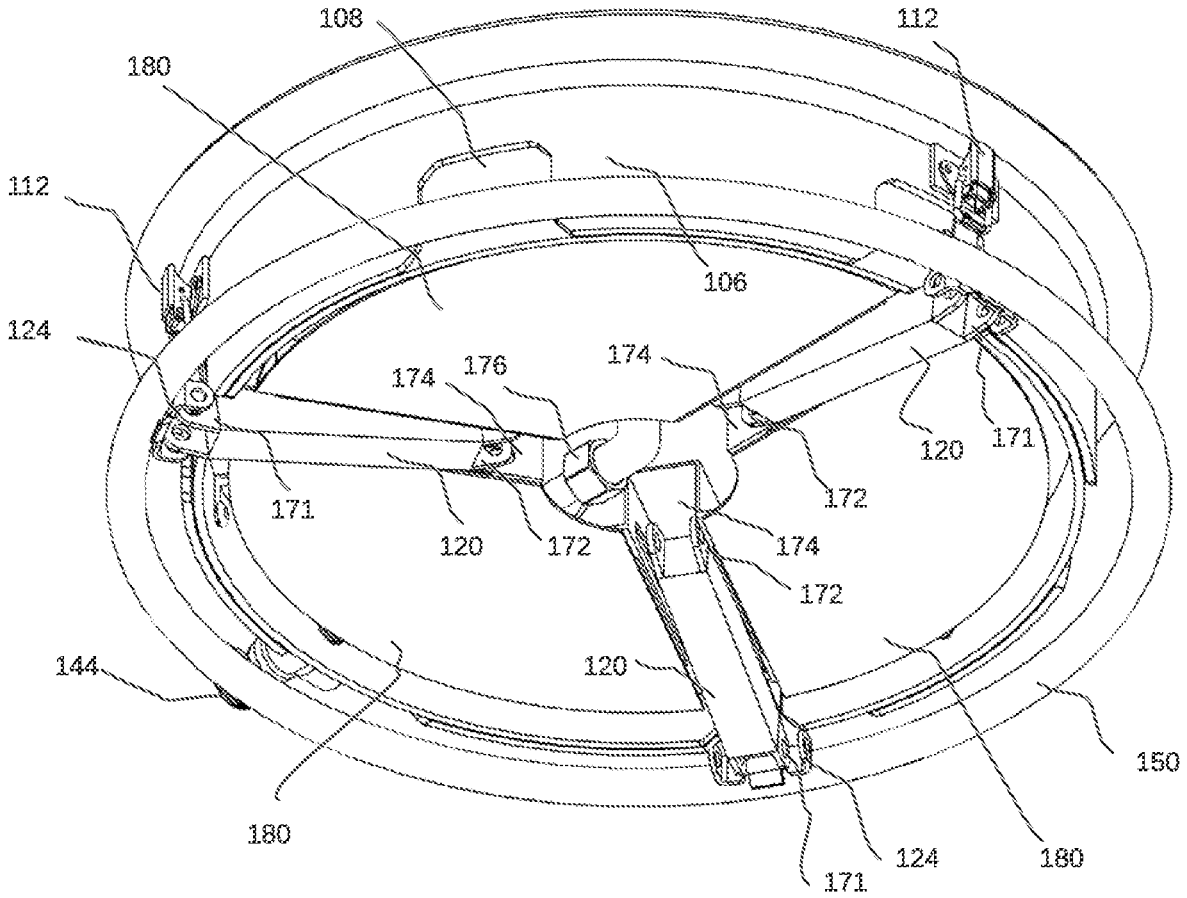
FIG. 4 illustrates a side/bottom view of the fire pit collapsed in accordance with example embodiments.

FIG. 4 illustrates a side/bottom view of the fire pit collapsed in accordance with example embodiments. Referring to FIG. 4, the collapsed position can be achieved by lifting the fire pit again so the legs 120 are now free to move in the guide rails 174. The lifting may cause the pin of the top guide pin holes 172 to unlock from a curved portion 178 of the guide rails 174. The buckle 112 can secure the clamp 124 in a position that holds the upper portion 114 over the lower portion 106 in a locked position with the base 150 locked to the clamp 124 and the buckle 112. The height of the fire pit is substantially smaller than when in an extended position, such as by half or approximately half of the extended height. The height could be even smaller, such as a third or fourth depending on the size of the cylindrical sections and the number of cylindrical sections, which could be greater than two.

Figure 5:
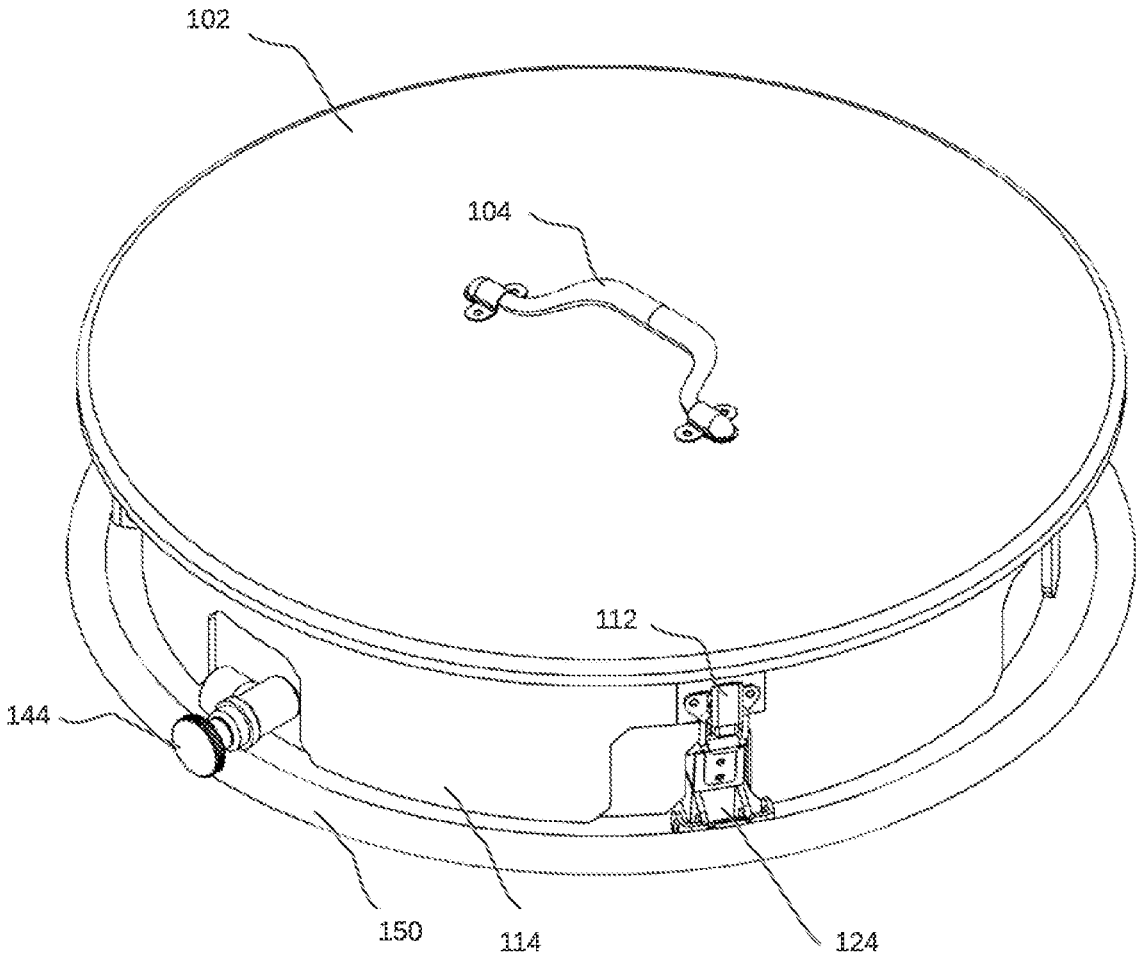
FIG. 5 illustrates a top/side view of the fire pit collapsed with a lid in accordance with example embodiments.

FIG. 5 illustrates a top/side view of a collapsed fire pit with a lid in accordance with example embodiments. Referring to FIG. 5, the lid 102 is illustrated as covering the collapsed fire pit as the buckle 112 is locked with the clamp 124. The collapsed fire pit can occupy less space and can even be carried on a backpack with straps holding the handle and/or ring 150 to the backpack or other carrying device.

Figure 6:
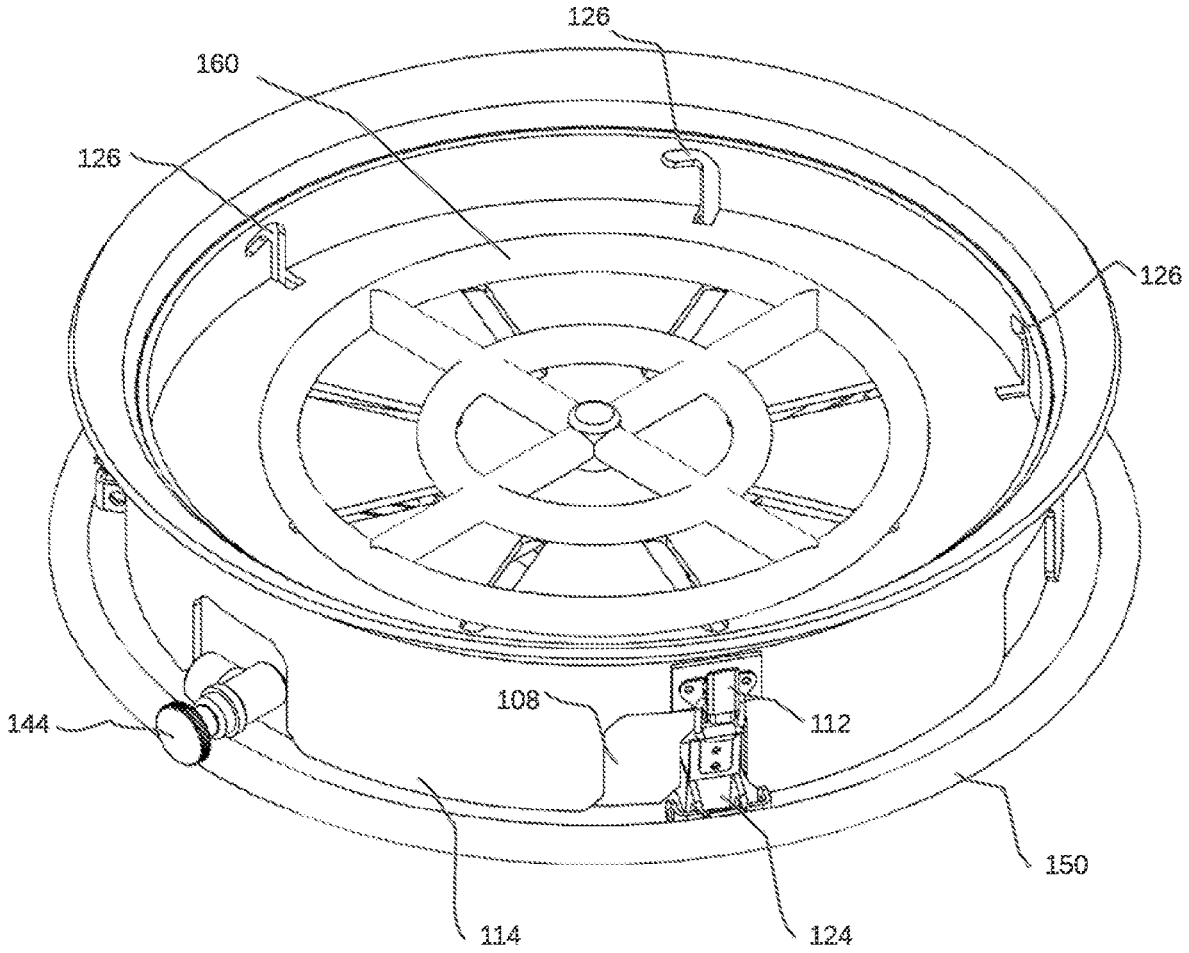
FIG. 6 illustrates a top/side view of the fire pit collapsed without a lid in accordance with example embodiments.

FIG. 6 illustrates a top/side view of a collapsed fire pit without a lid in accordance with example embodiments. In this example, the guide pin 118 is recessed beneath the elongated portions and the curved portions 126 and is out of sight.

Figure 7A:
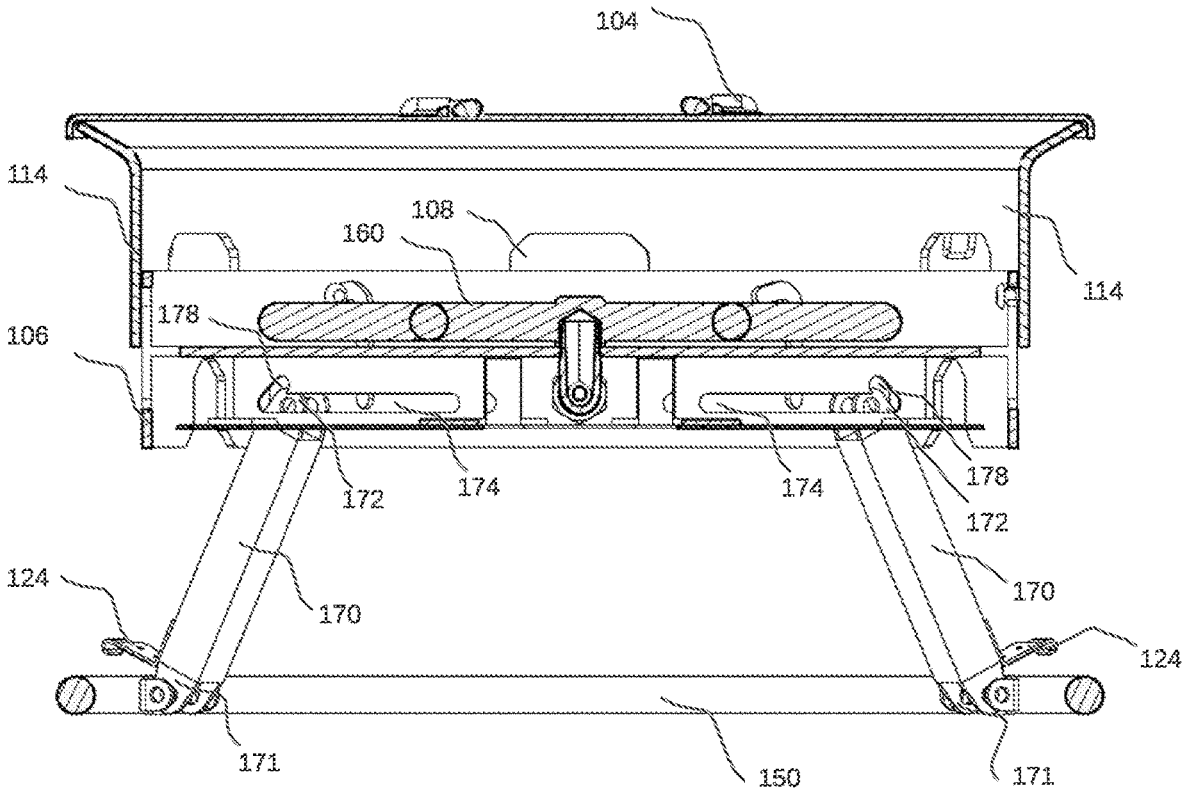
FIG. 7A illustrates a side sectional view of the fire pit extended with a lid in accordance with example embodiments.

FIG. 7A illustrates a side sectional view of an extended fire pit with a lid in accordance with example embodiments. Referring to FIG. 7A, the top set of holes 172 of each leg can be aligned with the curved portion 178 of the guide rails 174 to lock the legs in an extended position.

Figure 7B:
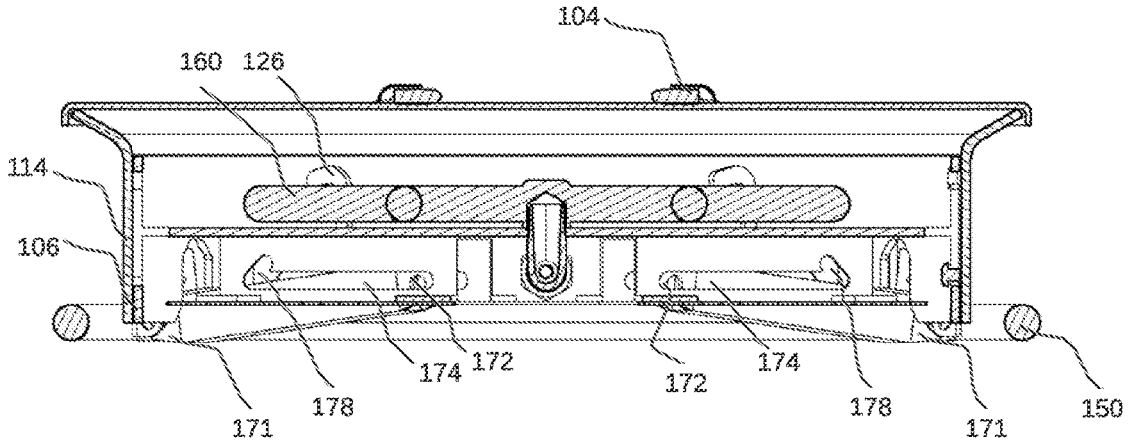
FIG. 7B illustrates a side sectional view of fire pit collapsed with a lid in accordance with example embodiments.

FIG. 7B illustrates a side sectional view of a collapsed fire pit with a lid in accordance with example embodiments. Referring to FIG. 7B, the top set of holes 172 of each leg are guided to the resting position along the guide track of the guide rails 174 to lock the legs in a collapsed position. Again, the holes 172 and 171 are maintained in position of the track via guide pins (not shown).

Figure 8A:
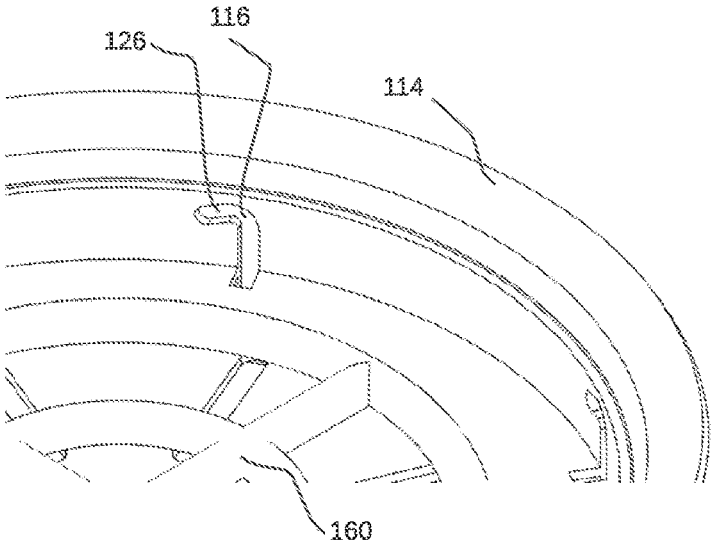
FIG. 8A illustrates a top/side view of the fire pit in a collapsed position according to example embodiments.

FIG. 8A illustrates a top/side view of the fire pit in a collapsed position according to example embodiments. Referring to FIG. 8A, the collapsed position of the fire pit demonstrates that the guide pin 118 is out of sight with respect to the elongated gap 116 since it is affixed to the lower portion 106.

Figure 8B:
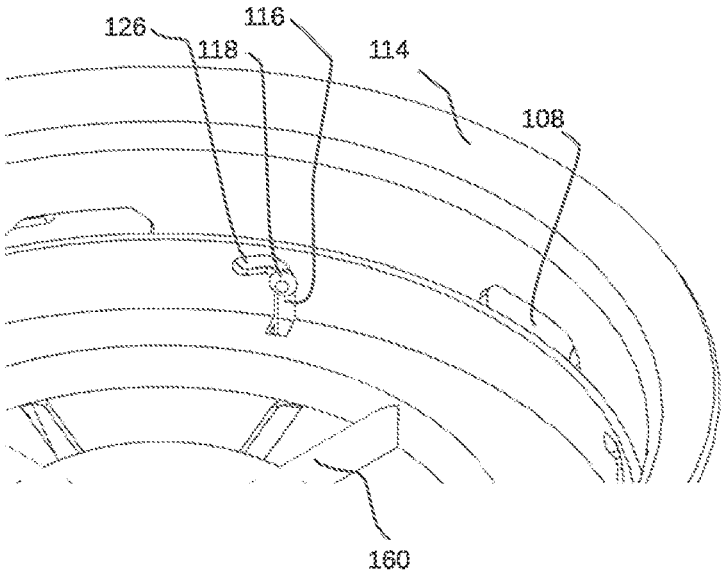
FIG. 8B illustrates a top/side view of the fire pit in a partially extended position according to example embodiments.

FIG. 8B illustrates a top/side view of the fire pit in a partially extended position according to example embodiments. Referring to FIG. 8B, the guide pin 118 is in an intermediate position since the top portion 114 is now slightly elevated during a lifting and turning operation performed by a user to extend the fire pit by lifting the top portion away from the ground and by turning the top portion to lock it into a fixed position guided by the guide pin and the elongated gap 116.

Figure 8C:
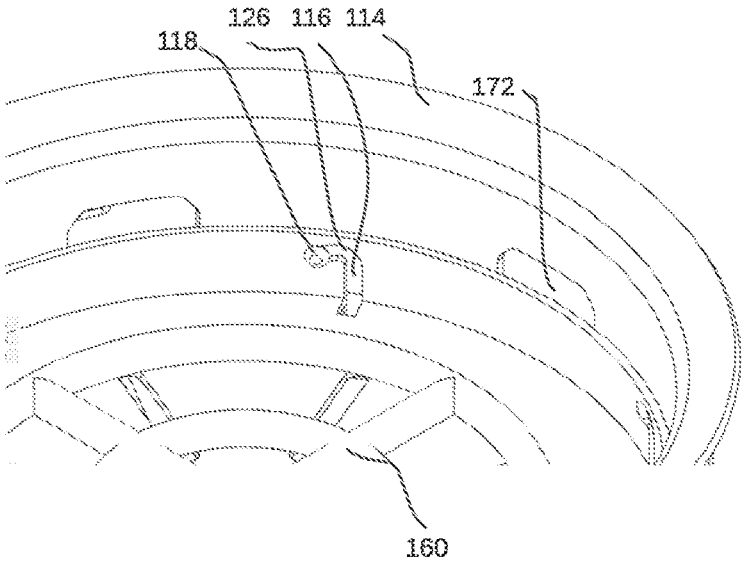
FIG. 8C illustrates a top/side view of the fire pit in a fully extended position according to example embodiments.

FIG. 8C illustrates a top/side view of the fire pit in a fully extended position according to example embodiments. Referring to FIG. 8C, the guide pin 118 is in a completed and secured position of the curved portion 126 of the elongated gap 116.

One example apparatus may include a plurality of different sized cylindrical sections, such as 106 and 114, with a largest outer layer section 114 and one or more inner layer sections 106 and possibly additional sections (not shown) affixed to one another to create a voluminous area when extended and locked via one or more locks, a plurality of slidably movable and/or pivoting legs 120 to support the plurality of different sized sections, and the plurality of legs are extended upward away from a resting surface along respective guide tracks 174.

There may be a fuel line 176 and a fuel input interface and/or igniter 144 to provide fuel and ignition to initiate a fire inside the voluminous area inside the pit. The plurality of pivoting legs 120 are affixed to one of the one or more inner layer sections via a plurality of respective slide tracks 174 which house the pivoting legs in a collapsed position. The plurality of pivoting legs 120 are affixed to a cylindrical ring 150 via a plurality of clamps 124 which are affixed to the pivoting legs 120 in an extended position. The apparatus also includes a plurality of buckles 112 affixed to the outer layer section 114 which lock on to the respective plurality of clamps affixed to the pivoting legs. In a collapsed position, the outer cylindrical section 114 covers an outer surface area of the one or more inner cylindrical sections 106. The outer cylindrical section 114 include a plurality of gaps 108 which extend from a bottom lip of the outer cylindrical section upward without covering an entire distance of the outer cylindrical section (approximately ½ or ⅔ or ¾ of the entire height distance of the layer), and the inner cylindrical layer includes a plurality of smaller gaps 122 contiguous with the pivoting legs 120, and the plurality of gaps 108 are wider than the plurality of smaller gaps 122 in this example. However, the gaps sizes may vary and may be the same size. The one or more locks may be based on gaps 116 which include a curved portion 126 and one or more guide pins 118 which lock into the curved portions 126 of the elongated gaps 116 of one of the one or more inner cylindrical sections. In this example, the lock mechanism is built into the inner cylindrical layer 106 and the guide pin 118 is affixed to the outer layer. Also, each of the pivoting legs includes pivoting slots which are a set of holes on both ends 171/172 which engage respective pins (not shown) to hold the pivoting legs to the clamps on one end and to a plurality of respective slide tracks on the other end.

In general, the fire pit is extended/erected by a lift and turn operation, the user would grab the top or upper portion 114 via a curved rim portion of the upper portion that is easy to hold in one's hand and pinch with one's fingers. The weight of the metal-based components would cause the legs to slide via their pin arrangement within the leg tracks and lock into a fixed position via the curved portion 178 of the leg tracks 174. As the legs lock into position, the user can then turn the top portion 114 to lock the guide pin 118 into the curved portion 126 of the elongated gap 116. This would create two locked positions which can easily be reversed by performing an opposite turning movement and an additional lifting operation to release the locked positions and collapse the fire pit.

Another example may include a grill over the heating element to accommodate cooking food. The fire pit may be a cooking grill that has a pan to catch grease, a grill that overlays the heating array to permit food to be laid on top during a heating session.

It will be readily understood that the components of the invention, as generally described and illustrated in the figures herein, may be arranged and designed in a wide variety of different configurations. Thus, the detailed description of the embodiments is not intended to limit the scope of the invention as claimed, but is merely representative of selected embodiments of the invention.

One having ordinary skill in the art will readily understand that the invention as discussed above may be practiced with steps in a different order, and/or with hardware elements in configurations that are different than those which are disclosed. Therefore, although the invention has been described based upon these preferred embodiments, it would be apparent to those of skill in the art that certain modifications, variations, and alternative constructions would be apparent, while remaining within the spirit and scope of the invention.

While preferred embodiments of the present application have been described, it is to be understood that the embodiments described are illustrative only and the scope of the application is to be defined solely by the appended claims when considered with a full range of equivalents and modifications thereto.

What is claimed is:

1. An apparatus comprising:

a plurality of different sized cylindrical sections, comprising a largest outer cylindrical section and one or more inner cylindrical sections affixed to one another to create a telescoping voluminous area comprising a fire distribution array when extended and locked via one or more locks which lock the largest outer cylindrical section to the one or more inner cylindrical sections;

a plurality of legs to support the plurality of different sized sections off a resting surface, wherein the plurality of legs fold out from underneath the plurality of different sized cylindrical sections or pivot along a respective guide track into a locked position; and wherein the one or more locks are affixed to an outer surface area of the outer cylindrical section to secure the outer cylindrical section in a fixed position over an outer surface area of the one or more inner cylindrical sections.

2. The apparatus of claim 1, comprising a fuel line and igniter to provide fuel and ignition to initiate a fire inside the voluminous area.

3. The apparatus of claim 1, wherein the plurality of legs are affixed to one of the one or more inner layer sections via a plurality of respective slide tracks which house the plurality of legs in a collapsed position.

4. The apparatus of claim 1, wherein the plurality of legs are affixed to a cylindrical ring via a plurality of clamps affixed to the plurality of legs in an extended position.

5. The apparatus of claim 4, wherein the outer cylindrical section comprises a plurality of gaps which extend from a bottom lip of the outer cylindrical section upward without covering an entire distance of the outer cylindrical section, and the one or more inner cylindrical sections comprise a plurality of smaller gaps contiguous with the plurality of legs, wherein the plurality of gaps are wider than the plurality of smaller gaps.

6. The apparatus of claim 4, comprising a plurality of buckles affixed to the outer layer section which lock on to the respective plurality of clamps affixed to the plurality of pivoting legs.

7. The apparatus of claim 1, wherein, in a collapsed position, the outer cylindrical section is larger than an outer surface area of the one or more inner cylindrical sections.

8. The apparatus of claim 1, wherein the one or more locks comprise one or more guide pins locked into curved portions of elongated gaps of one of the one or more inner cylindrical sections.

9. The apparatus of claim 1, wherein each of the plurality of legs comprise pivoting slots on both ends which engage respective pins to hold the plurality of pivoting legs to the clamps on one end of each of the plurality of legs and to a plurality of respective slide tracks on the other end of each of the plurality of legs.

* * * * *